United States Patent [19]

Hayhurst

[11] 4,143,611

[45] Mar. 13, 1979

[54] LEEWARDLY ALIGNED SAIL SUPPORT SYSTEM

[76] Inventor: Thomas S. Hayhurst, 10 Grove St., Ridgefield Park, N.J. 07660

[21] Appl. No.: 721,446

[22] Filed: Sep. 8, 1976

[51] Int. Cl.[2] ..... B63B 15/00

[52] U.S. Cl. ..... 114/90; 114/103; 114/112; 114/108

[58] Field of Search ..... 114/39, 89, 90, 91, 114/94, 95, 96, 97, 101, 100, 102, 103, 108, 111, 112, 113, 114

[56] References Cited

U.S. PATENT DOCUMENTS

| | | | |
|---|---|---|---|
| 253,528 | 2/1882 | Haggerty | 114/114 |
| 601,282 | 3/1898 | Sands | 114/108 |

*Primary Examiner*—Duane A. Reger
*Assistant Examiner*—D. W. Keen

[57] ABSTRACT

Sail is leewardly positioned with respect to the mast by flexible panels attached at, and extending aftwardly from a point approximately at the greatest width of the mast. Sail is guided by transverse stiff members mounted on the panels at their aft edges, to a predetermined, aerodynamically efficient stopped position.

14 Claims, 10 Drawing Figures

FIG. 8
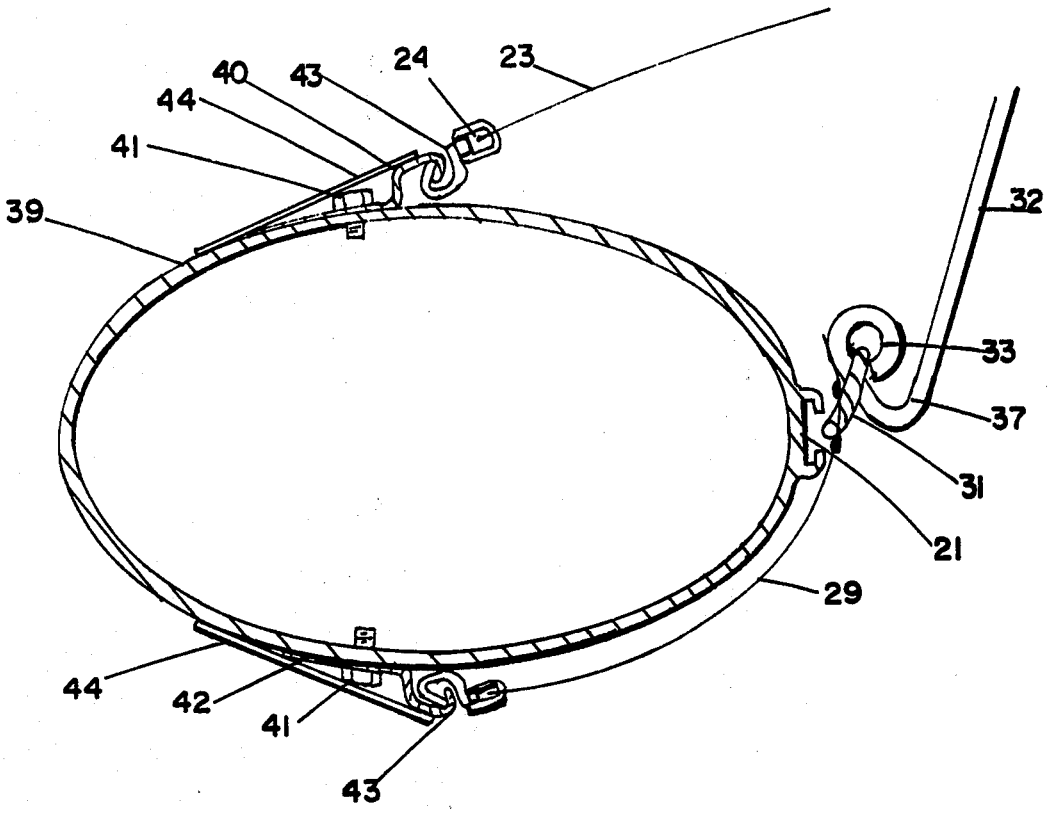
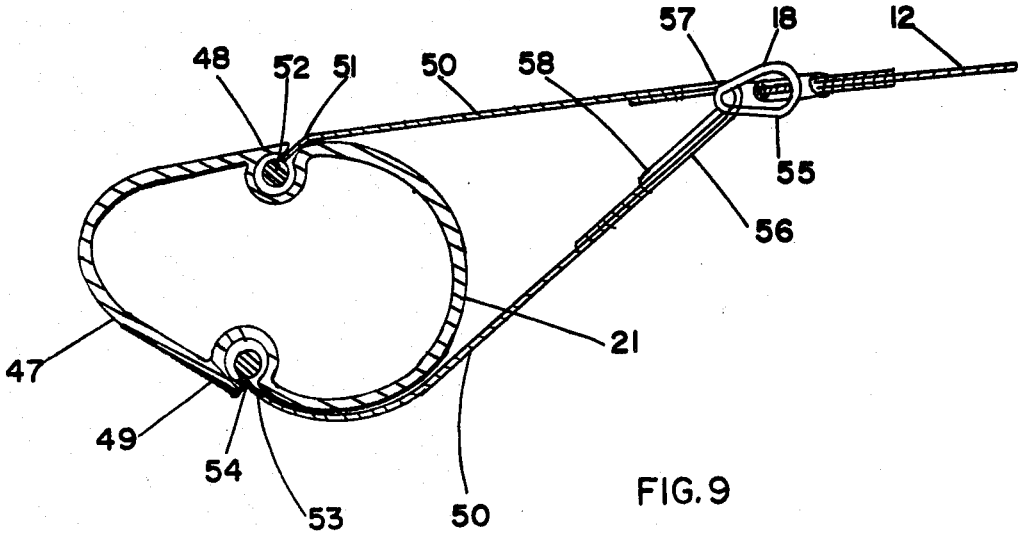
FIG. 9

LEEWARDLY ALIGNED SAIL SUPPORT SYSTEM

BACKGROUND

It is incredible to the inventor that; for the thousands of years man has used sail power to propel boats that the most aerodynamically efficient forms in use today should be among the oldest. In the rig in most common use today the sail is essentially supported at the windward portion of the mast. In the sailing maneuver in which most time is consumed; tacking or beating, the resultant airfoil configuration is roughly equivalent to the placement of an 18" dia. piece of sewer pipe along the top of the wing of a 747 at the forward edge and then expecting it to fly. The hereinafter disclosed invention provides an economical and convenient means whereby sails of conventional, single web form are positioned in the more efficient leeward position with respect to the mast.

SUMMARY

The subject invention utilizes a modified four-bar linkage system to provide self-tending means of maintaining positive alignment of a sail always with the leeward side of the mast. The linkage has been modified to the extent that; two of the members always being in tension, they could desirably be made of a flexible material, for instance; sailcloth. Being flexible, the windward of the pair has a tendency to wrap itself about the underlying portion of the mast, and the leeward one to assume a curvature normal to a sail. They, then could be in the form of panels of a length equal to the vertical edge of the sail, and desirably should be attached to the mast on it's flanks approximately at the point where the mast's width is greatest. The panels if embodied as separate elements would terminate in an aft transverse stiff member attached thereto by lines or other flexible means. The wind driven lateral motion causing the windward of the pair of panels to wrap about the aft flank of the mast, it will be foreshortened thereby causing the windward end of the transverse stiff member to br rocked forwardly. Thus biased leewardly the sail is urged into a position in alignment with the leeward of the panels, and predetermined to be an aerodynamically efficient position for that vehicle.

This application discloses three embodiments, each having it's own individual best use. One, the basic application is generally for use or cruising boats, used infrequently for racing. For this use the efficiency of the mast structure is the governing factor. Two, an embodiment for use on existing boats where the expense of replacing a mast would be prohibitive. And, three, an embodiment for use where maximum aerodynamic efficiency is the objective.

BRIEF DESCRIPTION OF THE DRAWINGS:

FIG. 8 Shows a second preferred embodiment adapted to apply the invention to conventional masts on existing boats.

FIG. 9 shows a third preferred embodiment intended for use in experimental vehicles and other applications requiring maximum aerodynamic efficiency.

DESCRIPTION OF INVENTION

Figure 1:
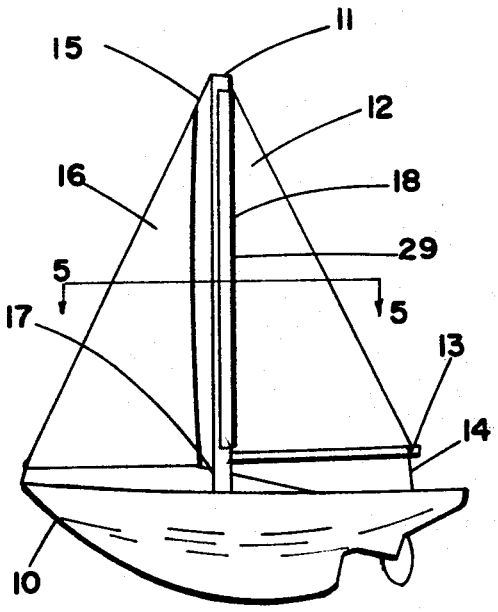
FIG. 1 is an elevation view showing the port side of a single masted sailboat, equipped with my mast and including mainsail, jib, and running gear.

Referring to FIG. 1, a sail propelled vehicle of any form, as, forinstance; a boat 10, having a mast 11 a conventional sail 12 rigged to operate aft of the mast 11 and to be controlled by boom 13 and sheet line 14. The FIG. also shows forestay 15 and jib 16 rigged to operate generally forward of said mast 11 as controlled by sheet line 17 and not part of this invention.

Figure 2:
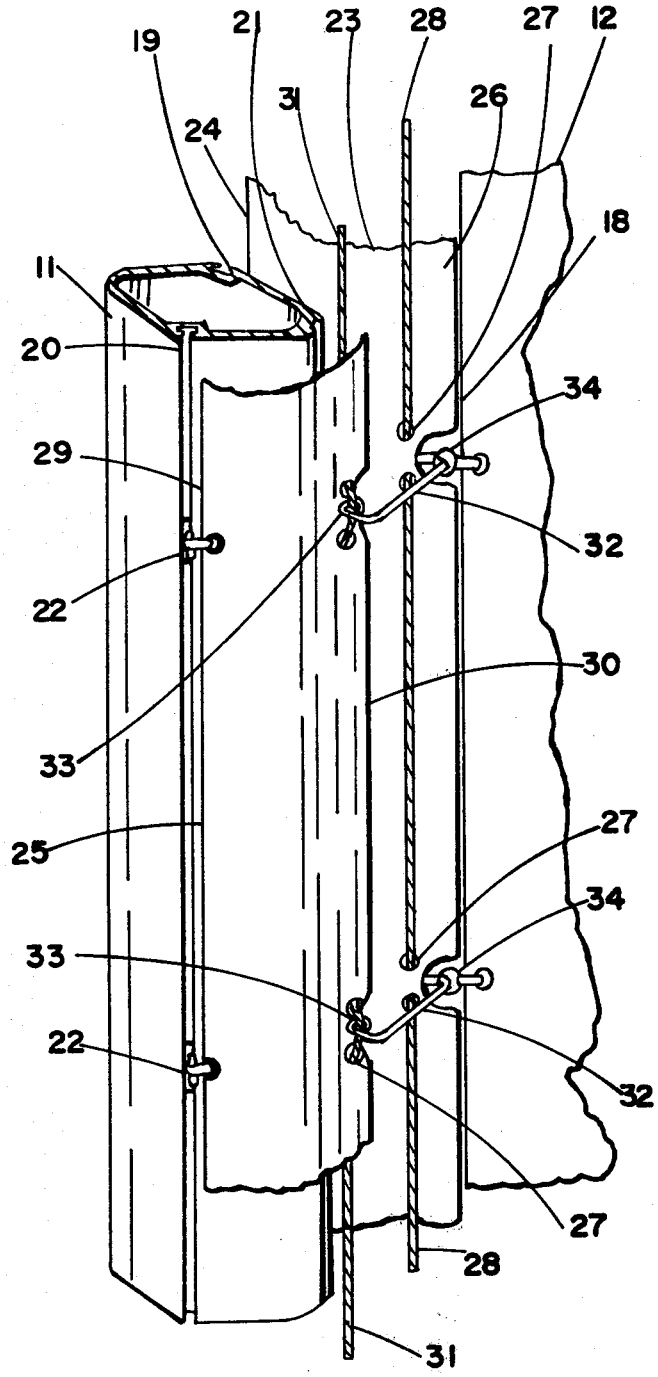
FIG. 2 is a partial perspective view of a preferred embodiment of my mast and sail attaching means.
Figure 4:
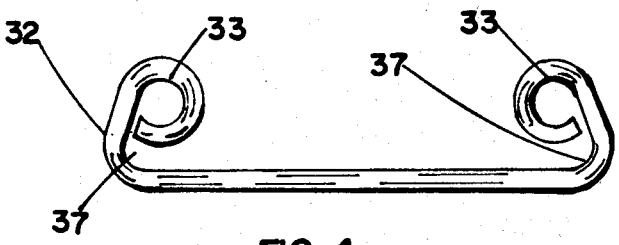
FIG. 4 is a detail plan view of the rocking transverse slide carrier.
Figure 5:
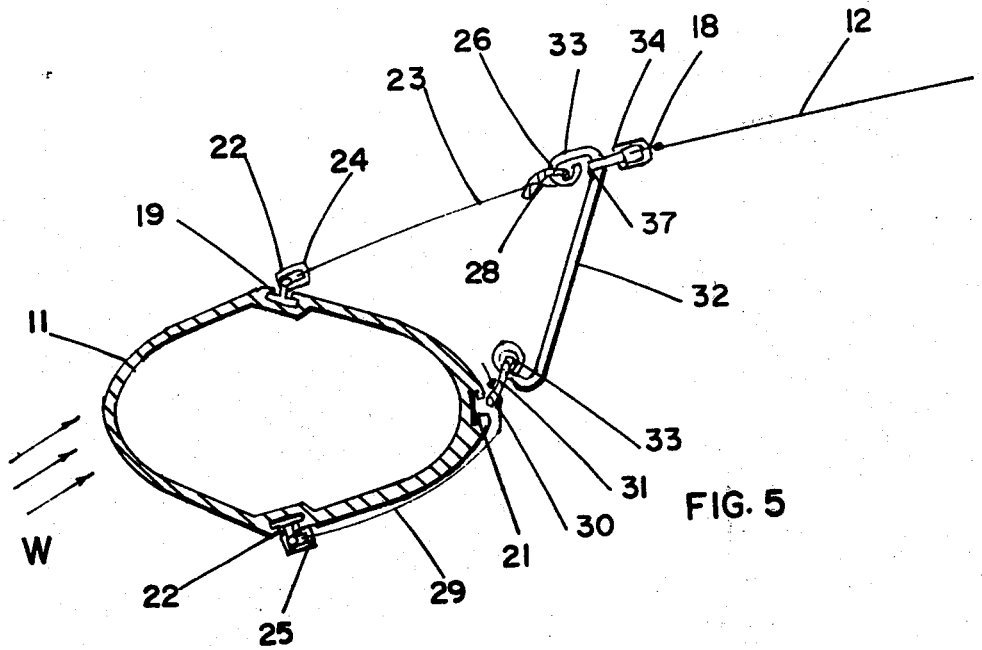
FIG. 5 is a plan section through the mast, showing the elements of my invention and a portion of the mainsail, all in a normal "port-tack" attitude.

Referring speciffically to sail 12 rigged to operate aft of said mast 11 and, in one embodiment, attached thereto by means more clearly shown in FIG. 2, and in FIG. 5. Sail 12 is attached at it's luff or forward edge 18 to a plurality to transverse slides 34 adapted to engage a plurality of rocking transverse slide carriers 32 shown in more detail in FIG. 4. Transverse slides engage the shank portion between hooks 37 and are limited in their lateral travel thereby. Hooks 37 on said transverse slide carriers 32 terminate at eyes 33 offset from shank portions thereof. Eyes 33 of said transverse slide carriers 32 are engaged by loops in starboard control line 28 and in port control line 31. Starboard control line 28 is slidably supported by guiding devices 27 located substantially at aft edge of filler panel 23 and port control line 31 is slidably supported by guiding devices 27 located substantially at aft edge of port filler panel 29. Starboard control line 28 and port control line 31 in addition to being the attaching means supporting slide carriers 32 to filler panels 23 and 29 may also be used by being adjustably let out, to control distance between aft edges of filler panel 23 and filler panel 29, or between leeward of said filler panels and luff 18 of sail 12 as indicated by widely varying sailing conditions.

Figure 3:
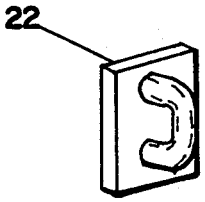
FIG. 3 is a detail perspective view of one form of a conventional sail slide.

Starboard filler panel 23 and port filler panel 29 have attached at their forward edges conventional sail slides 22 (shon in detail in FIG. 3)

Mast 11 has paired tracks located in it's flanks substantially forward of aft surface 21 of said mast 11. Starboard track 19 in the starboard flank of said mast 11 is engaged by plurality of sail slides 22 all attached by conventional means to starboard filler panel 23 at it's forward edge 24. Similarly port track 20 in the port flank of said mast llis engaged by a like plurality of slides 22 which are attached to port filler panel 29 at it's forward edge 25.

Referring specifically to FIG. 5 which shows relative positions of elements normal when the propelled vehicle is in a "port-tack"aspect; that is; the relative wind direction is from the port fore-quarter as shown by arrows W, it is to be observed that the exposed part of starboard flank portion of mast 11, starboard filler panel 23, and sail 12, together present a smooth, continuous, curved surface of aerodynamically efficient form. It will be obvious that; when course is changed or wind shifts, port-starboard relationships will be reversed and all elements will assume symetrically opposite relationships and a symetrically opposite smooth continuous curve will result.

Figure 6:
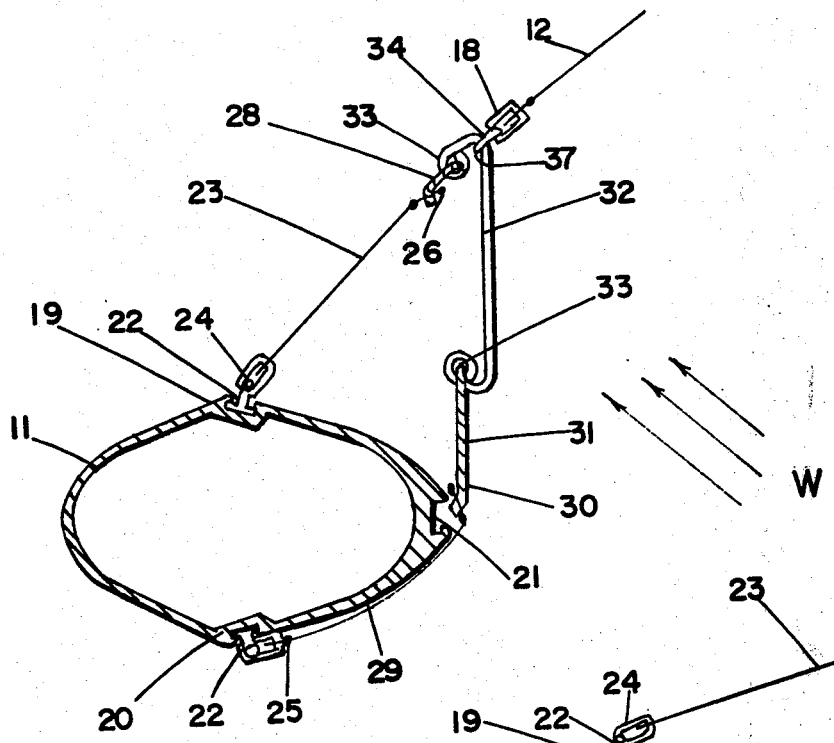
FIG. 6 is a plan section similar to FIG. 5, except that elements are shown in relative positions normal in a "run" attitude.

Referring specifically to FIG. 3 it is to be noted that while shank portion of transverse slide carrier 32 is shown to be straight, bowing or otherwise deforming said shank for special considerations would not constitute invention. FIGS. 5, 6, 7, and 8. All show an unused third slide track at aft surface 21 of mast 11. This track, in some form is essential on some boats for use when racing under certain interpretations of rules not permitting any deviation from historic rigs, it otherwise serves no purpose and inclusion or elimination do not constitute further invention. Referring not to FIG. 6 which shows elements in their respective positions normal when the apparent wind is from the aft port-quarter. Port control line 31 has been adjusted outwardly to allow the area of starboard filler panel 23 to augment the area of sail 12. It can be shown that, with wind from the aft starboard quarter port-starboard relationships are reversed and elements will assume symetrically opposite relationships.

Figure 7:
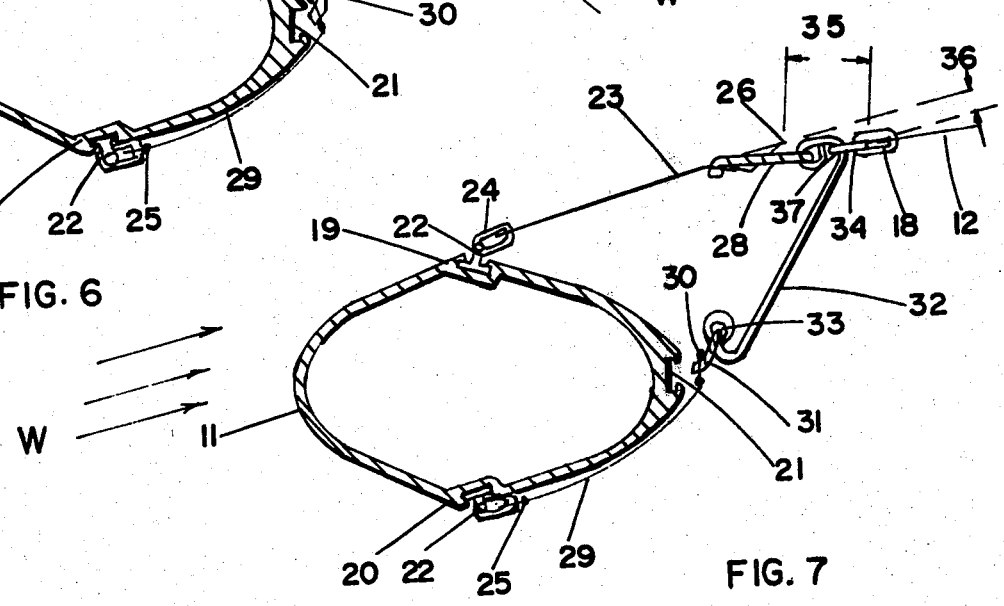
FIG. 7 is also a plan view similar to FIG. 5, except that a gap has been introduced between certain elements.

Referring now to FIG. 7, which shows elements in their respective positions normal when starboard control line 28 has been adjusted outwardly. A substantial gap 35 and an offset 36 have been introduced between aft edge 26 of filler panel 23 and luff edge 18 of sail 12. By dividing luff edge 18 of sail 12 into two or more zones and using a like plurality of segments of control lines 28, selective tapering of gap 35 and offset 36 may be accomplished. This is useful in controlling losses due to twisting of sail 12 under close hauled conditions.

Referring not to FIG. 8 modyfying parts have added to conventional mast section 39 to adapt it for use in this invention. Starboard track 40 is attached by screws 41 on the starboard flank of mast 39 and port track 42 is similarly attached by screws 41 both symetrically at locations substantially between fore and aft surfaces of mast 39. Starboard filler panel 23 is attached at it's forward edge 24 to plurality of filler panel slides especially adapted to engage Starboard track attachment 40 and port track attachment 42 which are identical except for mounting positions on mast section 39. Starboard filler panel is attached to filler panel slides 43 which engage starboard track attachment 40 and port filler panel 29 is similarly attached at it's forward edge 25 to a like plurality of filler panel slides 43 which are engaged in port track attachment 42. It can be shown that conventional mast section 39 with starboard track attachment 40 and port track attachment 42 fastenthereto by screws 41 and with filler panel slides 43 engaged therein is equivalent in all respects to mast 11 as hereinbefore disclosed.

Figure 10:
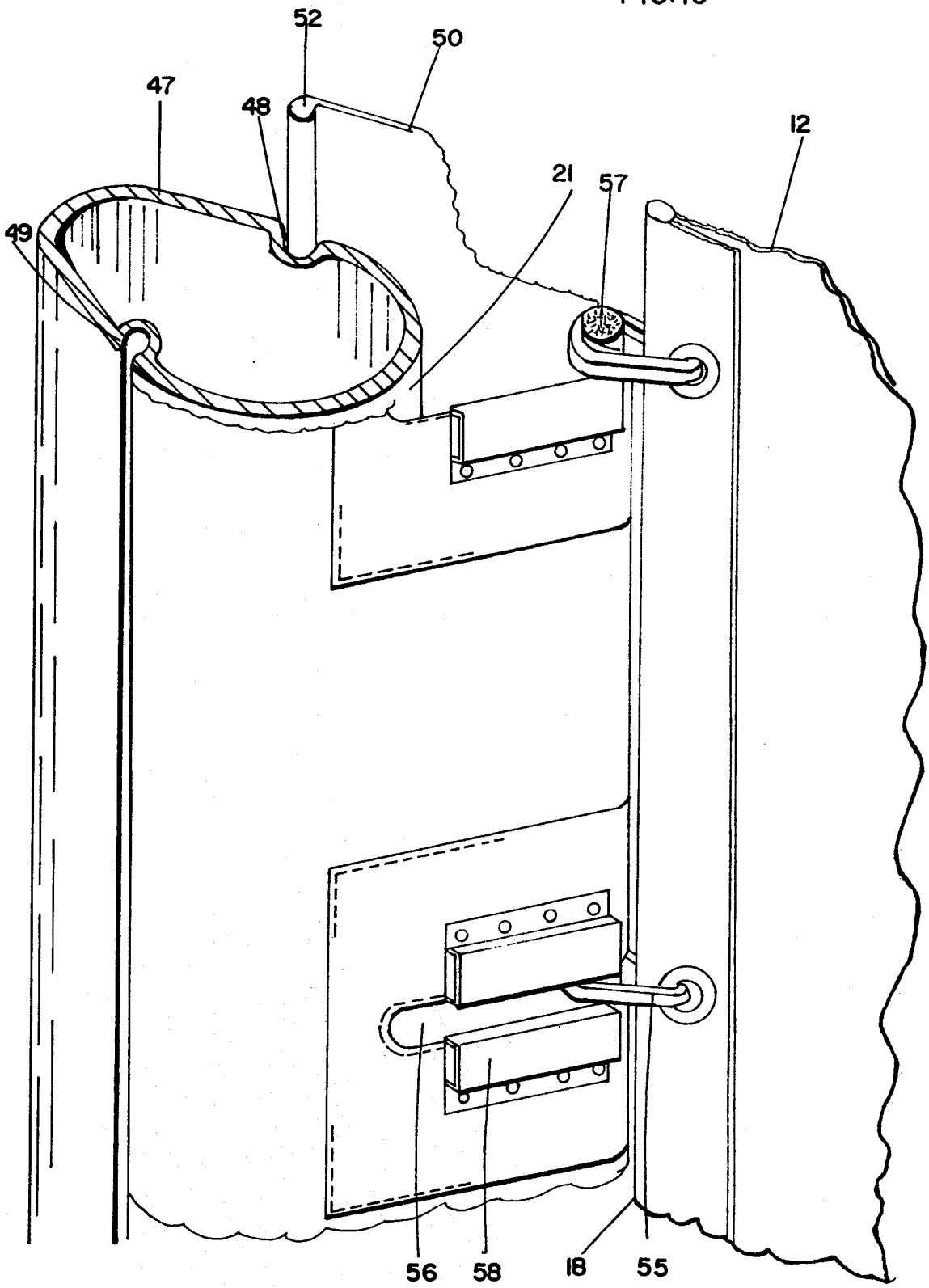
FIG. 10 shows the embodiment of FIG. 9 in perspective.

Referring now to FIG. 9 and FIG. 10 which show a third embodiment intended especially for uses in which high aerodynamic efficiency is the most important consideration:

A mast section 47 has in it's flanks conventional "bolt-rope" tracks; Starboard track 48 in the starboard flank and port track 49 in the port flank. Bolt ropes, conventionally attached at opposing vertical edges to wrap-around sheath 50, are adapted to be slidably engaged by said tracks; starboard track 48 engages starboard bolt rope 52 attached to sheath 50 at starboard edge 51 and port track 49 engages port bolt rope 54 attached to sheath 50 at port edge 53. Said wrap-around sheath is to be made of flexible material, as, for instance, sail cloth and is to be of vertical height approximately to the vertical dimension of luff 18 of sail 12 which is movably attached thereto by a plurality of forwardly extending loops 55 passing through a like plurality of transverse slits 56 at the approximate middle of sheath 50 and therein engaging a vertically disposed rope or other flexible device 57 internally enveloped by said sheath 50. Vertically disposed, one each above and below and with edges aligning edges of each transverse slit 56, rigid plates 58 are secured by conventional means to said wrap-around sheath either internally or externally. Said rigid plates 58 shall be of such transverse dimension as shall be determined by those skilled in the art and shall insure that rope 57 shall reliably move to and be accurately located at a leeward position past the center of sheath 50, such that the leeward composite surface consisting of; exposed leeward portion of mast 49, exposed leeward portion of sheath 50, and sail 12, shall be of a high efficiency aerodynamic form. to acheive this may require that each successive verically disposed pair of plates 58 be of a length differing from the others. Reinforcing devices, with or without rollers may be used internally of sheath 50 to stiffen short portions of rope 57 above and below locations of loops 55. Use of such devices would be considered normal performance of their art by sailmakers or riggers and would not be considered as limiting or extending the scope of this invention.

I claim:

1. A sail supporting system which comprises:

(1) a mast having a forward external curved surface with aftwardly diverging flank portions;

(2) a pair of engaging tracks located along the length of the flank portions of said mast substantially at or forward to the greatest width of said mast:

(3) a plurality of sliders engaged in said tracks:

(4) starboard and port filler panels attached at their forward edges to said sliders:

(5) a plurality of flexibility attached stiff crossmembers connecting the aft edges of said filler panels:

(6) an equal plurality of transversely sliding members engaging said cross-members: and (7) a sail supported along its luff edge by said equal plurality of transversely sliding members.

2. A sail supporting system according to claim 1 wherein the starboard and port filler panels are made of flexible material and are attached at their forward edge to said sliders.

3. A sail supporting system according to calim 2 wherein said slide engaging tracks are mounted on the outer surface of the mast substantially at or forward to the greatest width of said mast and extending vertically from about the junction of said mast with a boom to about the uppermost end of said mast.

4. A sail support system according to claim 3 wherein said slide engaging tracks are strip track attachments adapted to modify existing mast structures by being mounted onto the flanks thereof, at symmetrically located positions, along the length of the flank portions of said mast, substantially at or forward to the greatest width of said mast, and sliders adapted to engage said tracks.

5. A sail supporting system according to claim 2 wherein said slide engaging tracks are contained in the flanks of the mast substantially at or forward to the greatest width of said mast and extending vertically from about the junction of said mast with a boom to about the uppermost end of said mast.

6. The sail supporting system of claim 2 in which the starboard and port filler panels have at their edges guiding devices slidably engaged by flexible control lines, said control lines to slidably engage stiff cross members by being passed through eyes at each end thereof and continuously back through said guiding devices at said aft edges forming loops engaging said eyes of said stiff cross members, said loops being adapted to be adjustably varible in extent to adjustably position the luff edge of the said with respect to the flanks of the mast.

7. A sail supporting system of claim 2 in which the starboard and port filler panels extend aftwardly toward the aft edges of said filler panels, said aft edges being substantially aft of the aft external surface of the mast.

8. The sail supporting system of claim 7 in which the windward one of the starboard or port filler panels being urged by wind pressure to conform to the underlying surface of the aft portion of windward flank of the mast, aft edge of said windward panel will be biased to a position displaced forwardly from that of the leeward filler panel which is not so biased, and at said aft edges devices adapted to support a sail by it's luff edge.

9. The sail supporting system of claim 7 which the flexibly supported stiff cross members have shank portions, hook portions separated each from the other by said shank portions, and eyes offset from said shank portions by said hook portions, said stiff cross members being flexibly attached to the aft edges of filler panels by flexible means adapted to engage said eyes, and sliding devices adapted to engage said shank portions of said cross members, and be limited by hook portions thereof, and a sail attached to said sliding devices by it's luff edge.

10. The sail supporting system of claim 7 in which the extent of transverse movement of the plurality of sliding devices is predetermined by the configuration of the flexibly supported stiff cross members.

11. The sail supporting system of claim 10 in which the form of the external surface of the mast forward of the slide engaging tracks, the position relative to said external surface of said mast at which the sliders engaged in said support the filler panels attached thereto at their forward edges and the predetermined position at which the luff edges of a sail is supported all shall be such as to permit the creation of an aerodynamically efficient composite driving surface by conventional sail sheeting means.

12. The sail supporting system of claim 1 in which the stiff cross members are attached to starboard and port filler panels by starboard and port control lines slidably engaged in aft edges of said panels and slidably engaging ends of stiff cross members thereby providing means for adjustably controlling the position of the luff edge of the sail with respect to the leeward surface of the mast, or the aft edge of the leeward one of the filler panels.

13. A sail supporting system consisting of:

(1) a mast having a forward surface curved afterwardly and terminated at a pair of engaging tracks located substantially about the greatest width of said mast:

(2) a sheath attached by a vertical edge engaged in the starboard one of said tracks said sheath extending aftwardly to a position aft of the mast and at that position reversing direction and extending forwardly to the portside track wherein its vertical edge is similarly attached in the portside track thereby creating a vertical fold in the aftmost portion of said attached sheath:

(3) a plurality of vertically spaced transverse slits of predetermined length, said slits running the vertical length of said flod:

(4) linking devices passing through said slits engaging within said sheath flod a vertically disposed flexible device adapted to engage said sheath internally at said sheath flod:

(5) A sail attached at its luff edge to said sheath fold by said linking devices.

14. A sail supporting system according to claim 13 wherein said vertically spaced transverse slits contain stiffening devices of predetermined length less than the length of said slits and laterally disposed in a symmetrical manner with respect to said vertical edges of said sheath.

* * * * *